US006102324A

United States Patent [19]

Farrow et al.

[11] Patent Number: 6,102,324

[45] Date of Patent: Aug. 15, 2000

[54] COIL HITCHING DEVICE

[75] Inventors: Gregory John Farrow, Fergus; Robert Faulhammer; Robert Kinsie, both of Kitchener, all of Canada

[73] Assignee: ATS Automation Tooling Systems Inc., Cambridge, Canada

[21] Appl. No.: 09/326,576

[22] Filed: Jun. 7, 1999

[30] Foreign Application Priority Data

Jun. 8, 1998 [CA] Canada ..... 2240008

[51] Int. Cl.[7] ..... B21F 3/04

[52] U.S. Cl. ..... 242/437.2; 242/439.1; 29/605

[58] Field of Search ..... 242/440.1, 437.2, 242/439.1; 29/605

[56] References Cited

U.S. PATENT DOCUMENTS

| | | | |
|---|---|---|---|
| 3,213,894 | 10/1965 | Etchinson, Jr. et al. | 242/439.1 |
| 3,306,554 | 2/1967 | Henderson | 242/437.2 X |
| 4,177,555 | 12/1979 | Weltman et al. | 242/439.1 X |
| 4,331,182 | 5/1982 | Sprenkle | 242/439.1 X |
| 4,407,337 | 10/1983 | Hines et al. | 242/439.1 X |
| 4,809,917 | 3/1989 | Tsuchiya | 242/437.2 X |
| 4,836,461 | 6/1989 | Koizumi et al. | 242/437.2 |
| 5,092,530 | 3/1992 | Noirot et al. | 242/437.2 |
| 5,495,659 | 3/1996 | Beakes et al. . | |
| 5,526,993 | 6/1996 | Hamada . | |
| 5,531,390 | 7/1996 | Gustafson . | |
| 5,549,253 | 8/1996 | Beakes et al. . | |
| 5,560,555 | 10/1996 | Beakes et al. . | |
| 5,605,301 | 2/1997 | Ujita et al. | 242/437.2 X |
| 5,618,007 | 4/1997 | Beakes et al. . | |
| 5,649,353 | 7/1997 | Salasoo et al. . | |
| 5,685,061 | 11/1997 | Beakes . | |
| 5,699,977 | 12/1997 | Watanabe . | |
| 5,706,692 | 1/1998 | Chubb et al. . | |

FOREIGN PATENT DOCUMENTS

| | | | |
|---|---|---|---|
| 75843 | 7/1961 | France | 242/439.1 |
| 404098808 | 3/1992 | Japan | 242/439.1 |

OTHER PUBLICATIONS

Paolino, Double Concentric Bit, IBM Technical Disclosure Bulletin, vol. 4 No. 8, p. 12, Jan. 1962.

Bajan et al, Wire Wrapping Stylus, IBM Technical Disclosure Bulletin, vol. 14, No. 17, Dec. 1971.

*Primary Examiner*—Donald P. Walsh
*Assistant Examiner*—Emmanuel M. Marcelo
*Attorney, Agent, or Firm*—R. Craig Armstrong

[57] ABSTRACT

A dual mode coil hitching device used in the coil winding process is disclosed. The device operates in either a clamping or a tie-off mode. The device includes a sleeve and an actuated plunger. The sleeve has a first and second opening. The first opening has a coil scrapping surface adjacent thereto, and the second opening has an upper clamping surface. The plunger has a lower clamping surface opposing the upper clamping surface and a tie-off member disposed thereon. The plunger is slidably mounted within the sleeve and is positionable between a retracted position and an extended position. In the retracted position, the second opening of the sleeve and the lower clamping surface of the plunger define an exposed gap, and the tie-off member is completely positioned within the sleeve. In the extended position, the tie-off member extends outside the sleeve via the first opening, and the lower clamping surface confronts the upper clamping surface.

11 Claims, 17 Drawing Sheets

COIL HITCHING DEVICE

BACKGROUND OF THE INVENTION

1. Field of the Invention

This invention relates to coil winding. In particular, the invention is related to hitching the coil when the coil is being manipulated.

2. Description of the Prior Art

In the manufacture of wound coils, there is a requirement to temporarily hitch the coil during the winding process. For instance, when the wire is dispensed from a coil dispensing nozzle, it is loose and as a result cannot be effectively manipulated.

Therefore, the coil is then hitched at what is referred herein as a hitching station. The station will temporarily immobilize one end of the wire. Once the wire is hitched, the wire being dispensed from the nozzle may then be easily manipulated for the next step of the coil winding process. Generally speaking, the dispensing coil is required to be hitched at the beginning of the winding process and the end of the winding process.

Traditionally, this hitching feature may be accomplished by a clamping station working in conjunction with the winding machine. In circumstances where the coil is too thin to work effectively in a clamping station, a tie-off station is used instead. Both types of stations, however, do have drawbacks. First, due to the fact that the clamping station and the tie-off station are separate units the winding machine must be undesirably adapted to receive both types of stations because both types of stations may be required. Second, undesirable downtime for the winding machine is characteristic when manually switching over from using one type of station to another. Moreover, the complex manufacturing designs that now make up currently available clamping and tie-off stations are also undesirable.

SUMMARY OF THE INVENTION

It is an object of the invention to overcome some of the drawbacks of the prior art.

It is an object of the invention to provide a single unit to accomplish both clamping and tie-off modes for hitching coil during a coil winding process.

It is an object of the invention to provide an easy to manufacture single hitching unit.

The invention advantageously provides a single hitching station to operate in either a tie-off mode or a clamping mode without the undesirable significant downtime traditionally required to manually change over from one type of hitching station to the other. Moreover, the simple design of the invention allows for easier manufacture of the hitching station without undue complex moving components.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
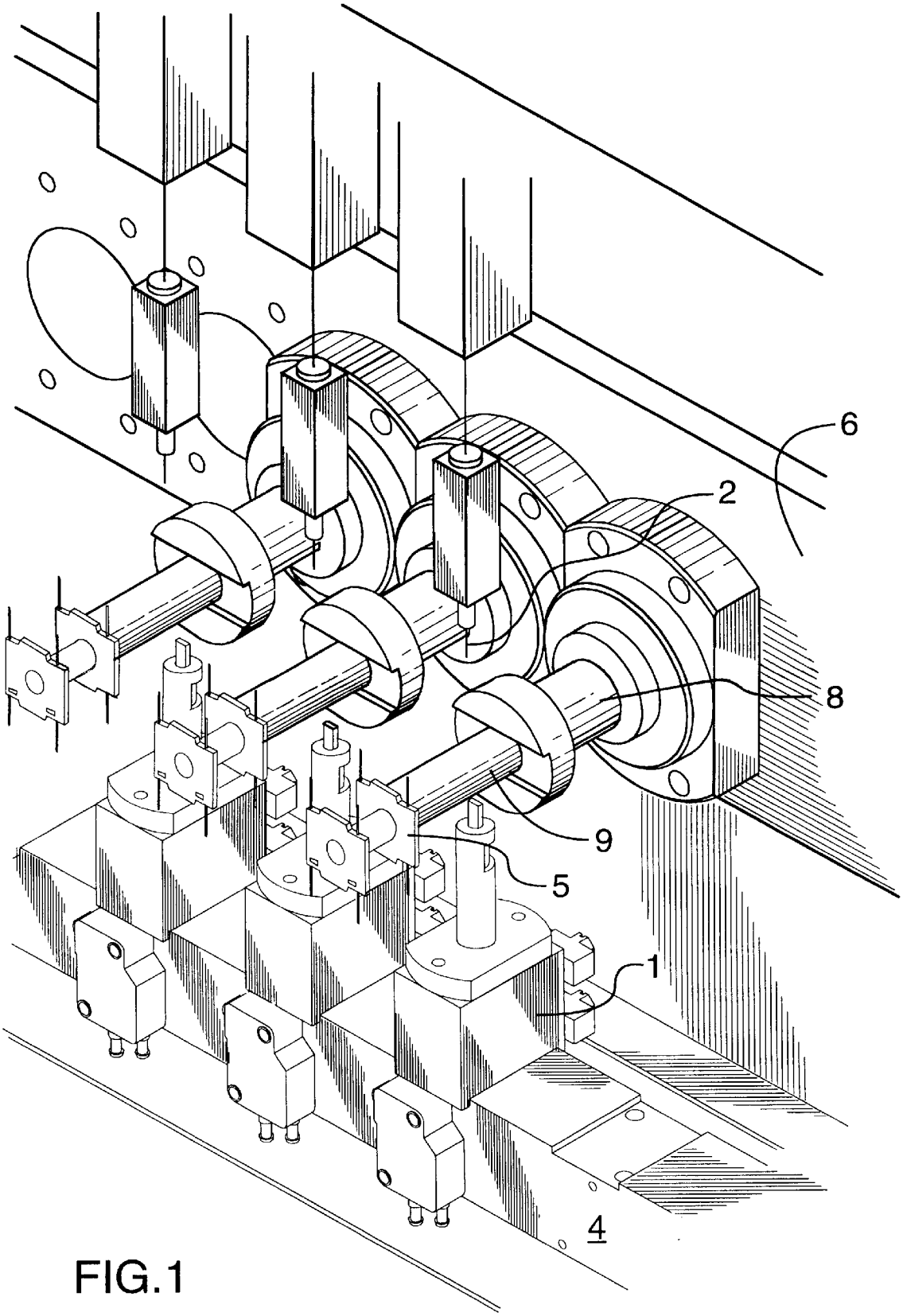
FIG. 1 is a perspective view of a plurality of hitching stations mounted onto a winding machine.
Figure 2:
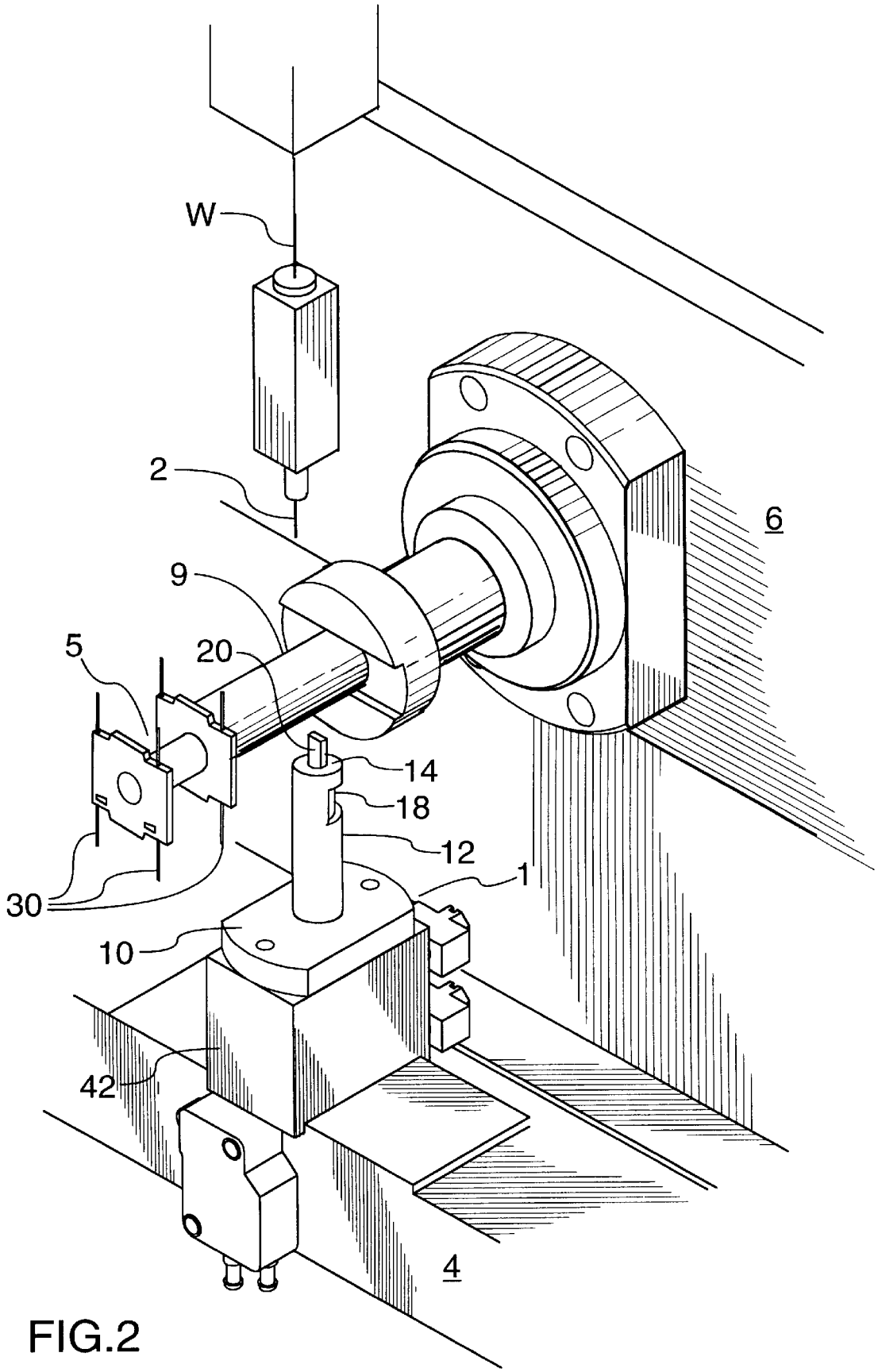
FIG. 2 is a perspective close-up view of a hitching station before any coil has been dispensed from the coil dispensing nozzle.
Figure 2A:
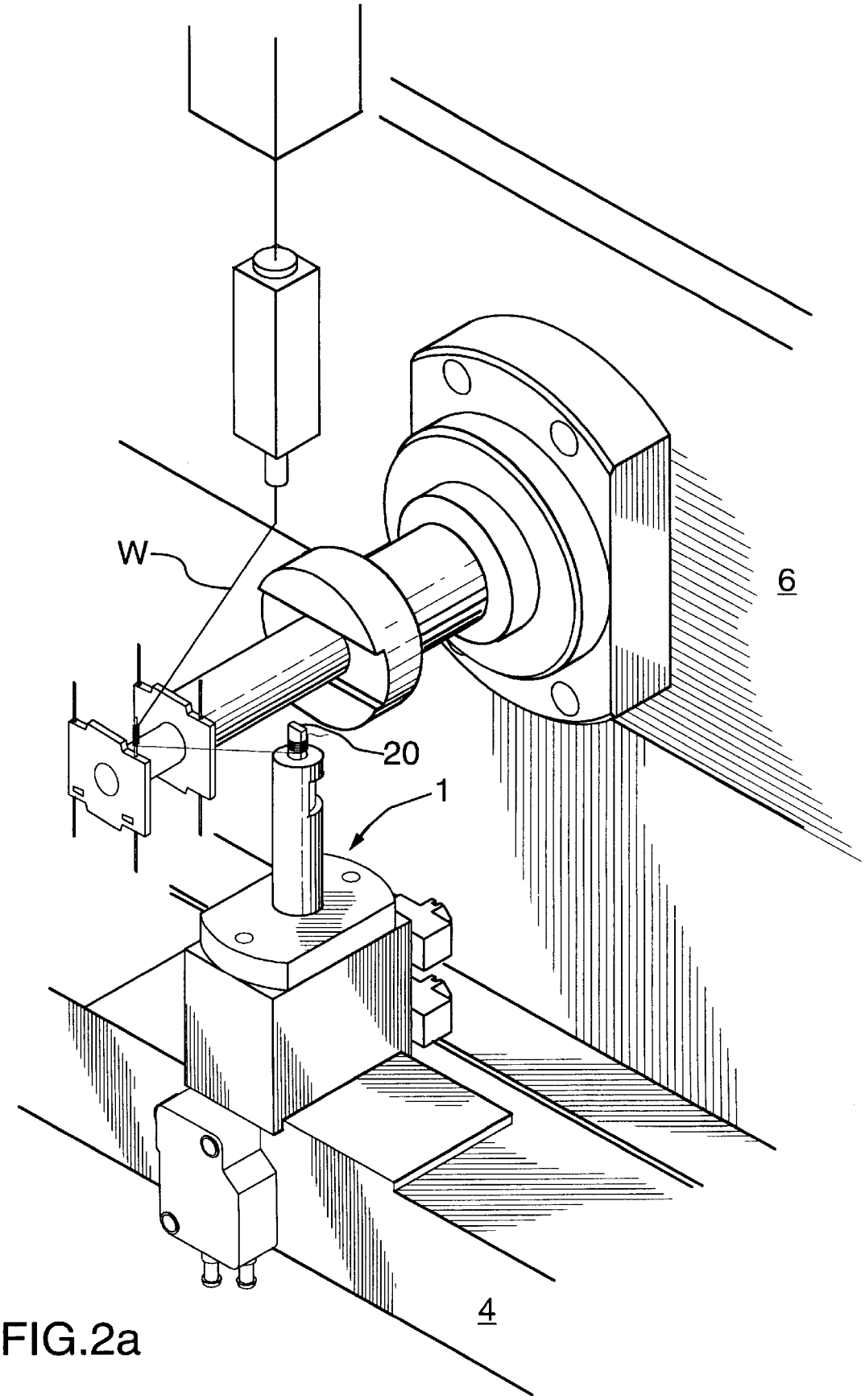
FIG. 2*a* is a perspective close-up view of a hitching station used in the tie-off mode prior to cutting the hitched portion of the coil to begin the coil winding.
Figure 2B:
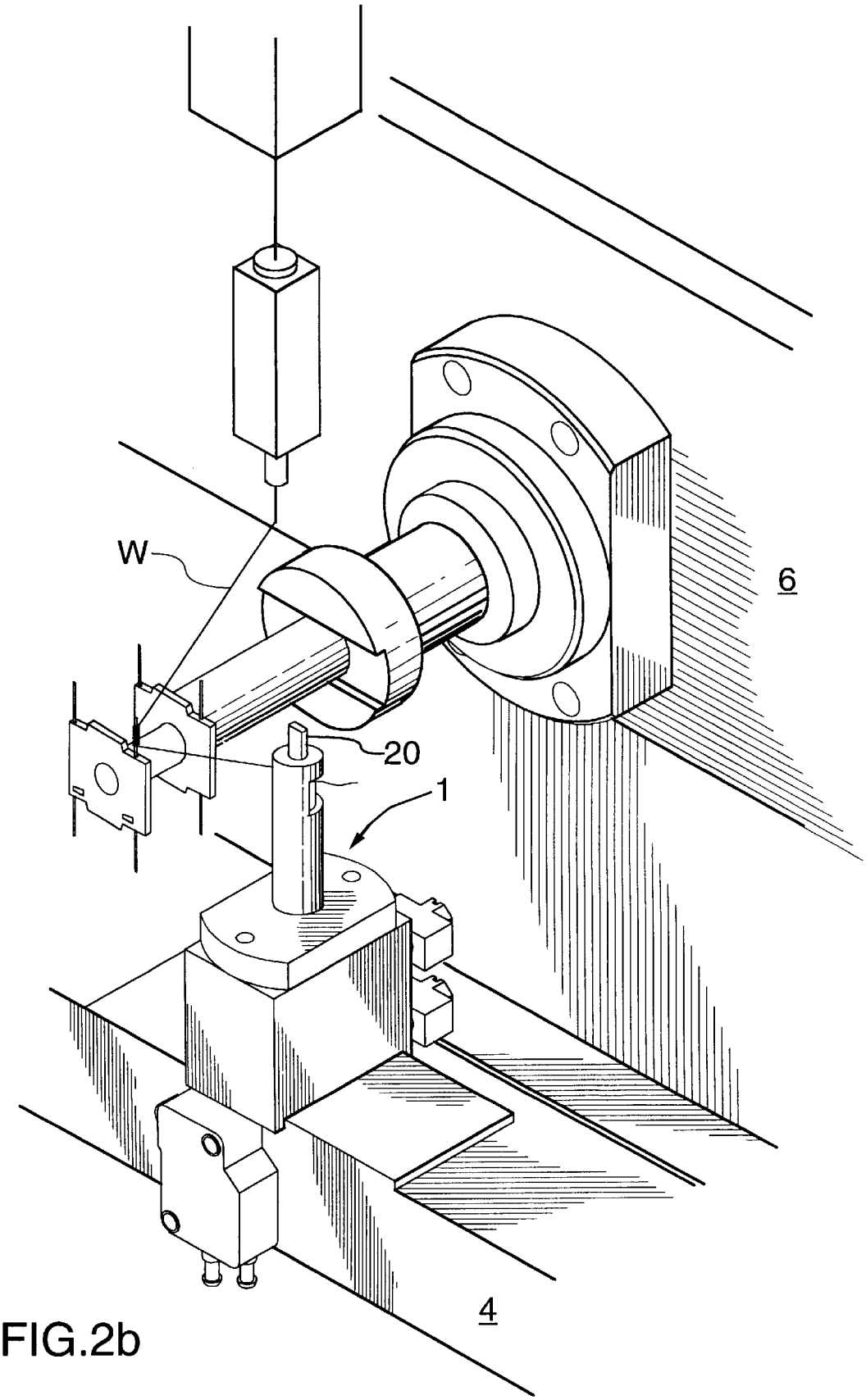
FIG. 2*b* is similar to the view of FIG. 2*a*, however, this view illustrates how the hitching station would appear if operating under the clamping mode.

A preferred embodiment of the invention is described with reference to FIGS. 1–12*b*. As shown in FIG. 1, there are a plurality of dual mode coil hitching stations 1 mounted onto a rotatable rail 4 of a winding machine, generally designated 6. Although only three stations are shown mounted onto the rail, other numbers of stations may be mounted thereon. In FIG. 2, the station is shown in a vertical position. Next to each of the stations, is a spindle 8 that receives an arbor 9 which includes a bobbin 5 having terminating pins 30.

Figure 3:
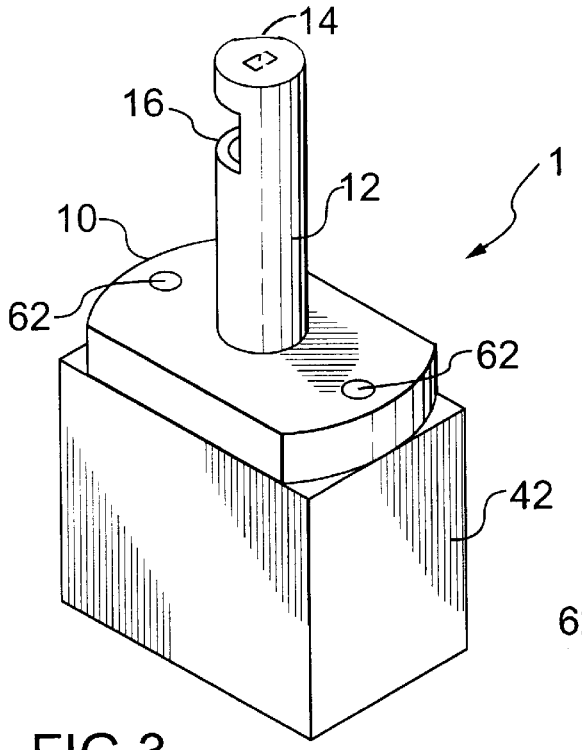
FIG. 3 is a front perspective view of a hitching station with the plunger retracted.
Figure 4:
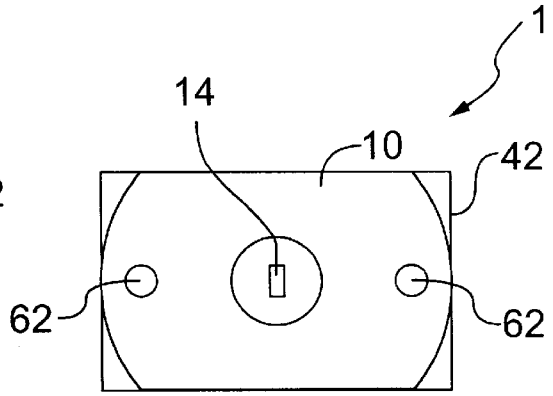
FIG. 4 is a top view of FIG. 3.
Figure 6:
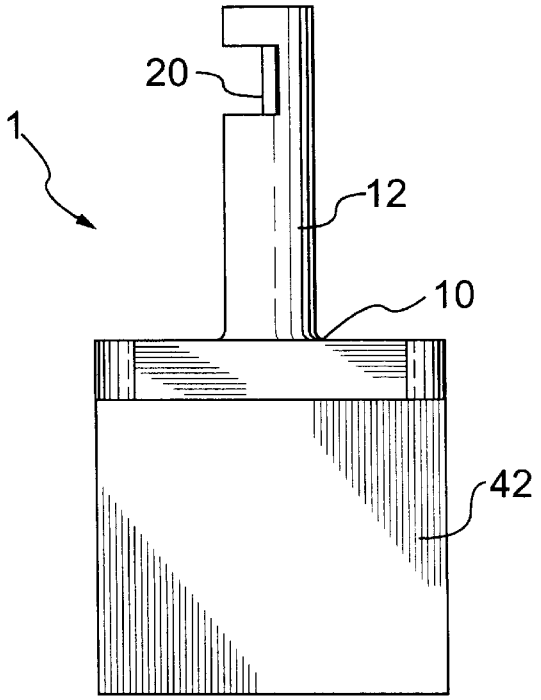
FIG. 6 is a side view of FIG. 3.
Figure 7:
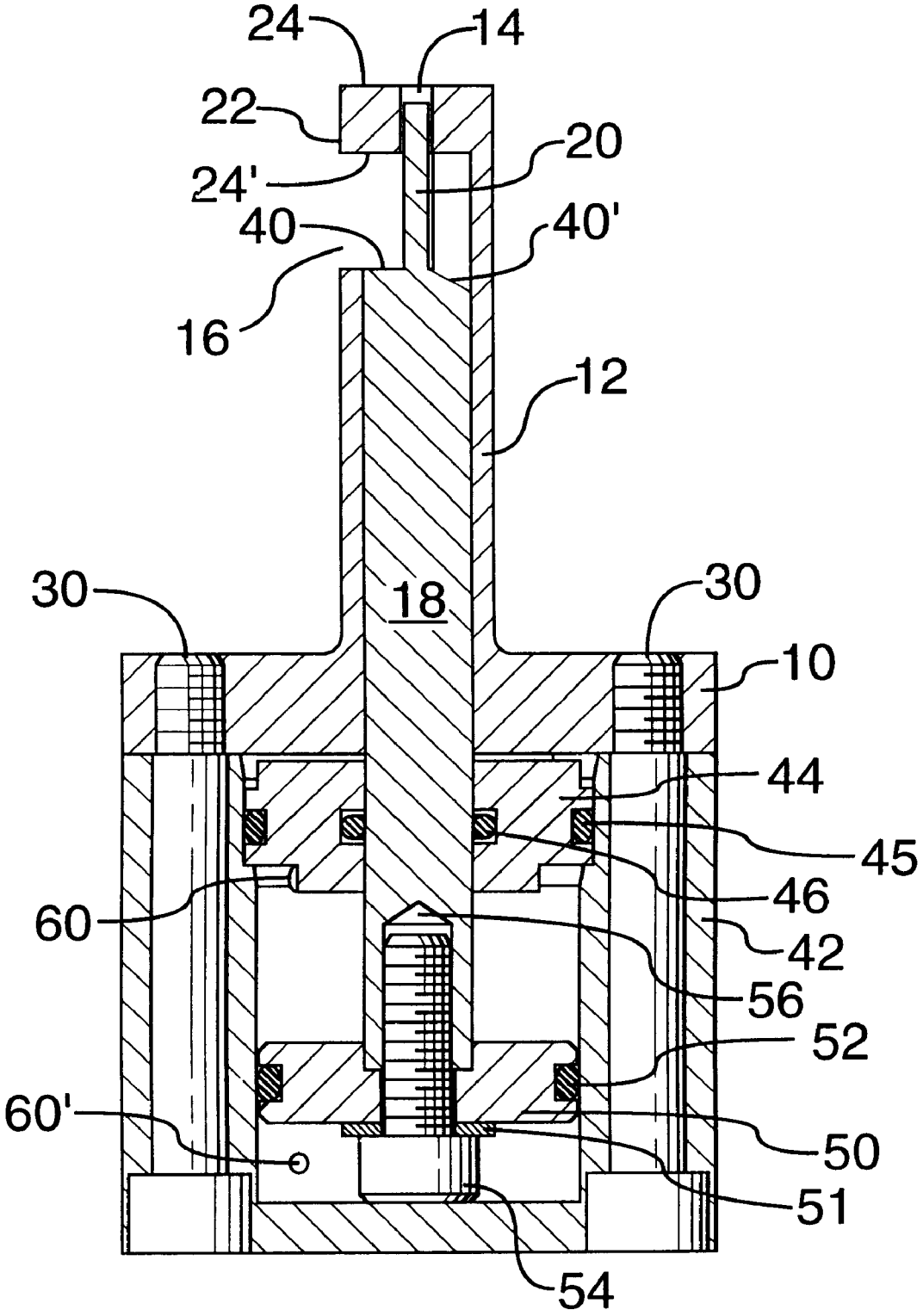
FIG. 7 is a cross-sectional view along line 7—7 in FIG. 5 with the plunger in a retracted position.

As a matter of convenience, the description that now follows will be respect to only one hitching station, but the description will equally apply to the plurality of stations that would typically be mounted onto a winding machine. With reference to FIG. 3, the hitching station comprises an upper body, generally designated 10, mounted by screws 62 onto a lower body, generally designated 42. The upper body includes a sleeve 12 that extends upwardly from a base of the upper body. As shown in FIG. 7, the sleeve is bored up to a lower surface 24' of a top end, generally designated 22, to receive a slidably mounted plunger 18 therein. A first opening 14 extends between a top surface 24 and a lower surface 24' of the top end. The top surface acts a coil scraping surface as will be described in more detail below. The first opening is preferably rectangularly shaped. On the lateral surface near the top of the sleeve there is a second opening 16 that cuts preferably beyond the centerline of the sleeve. Although there is shown a rectangular-shaped second opening, any suitably shaped opening may be defined on the cylinder. As will be discussed below, the first opening is directed for use when the hitching station is in a tie-off mode, while the second opening is used in the clamping mode of the hitching station.

Figure 7A:
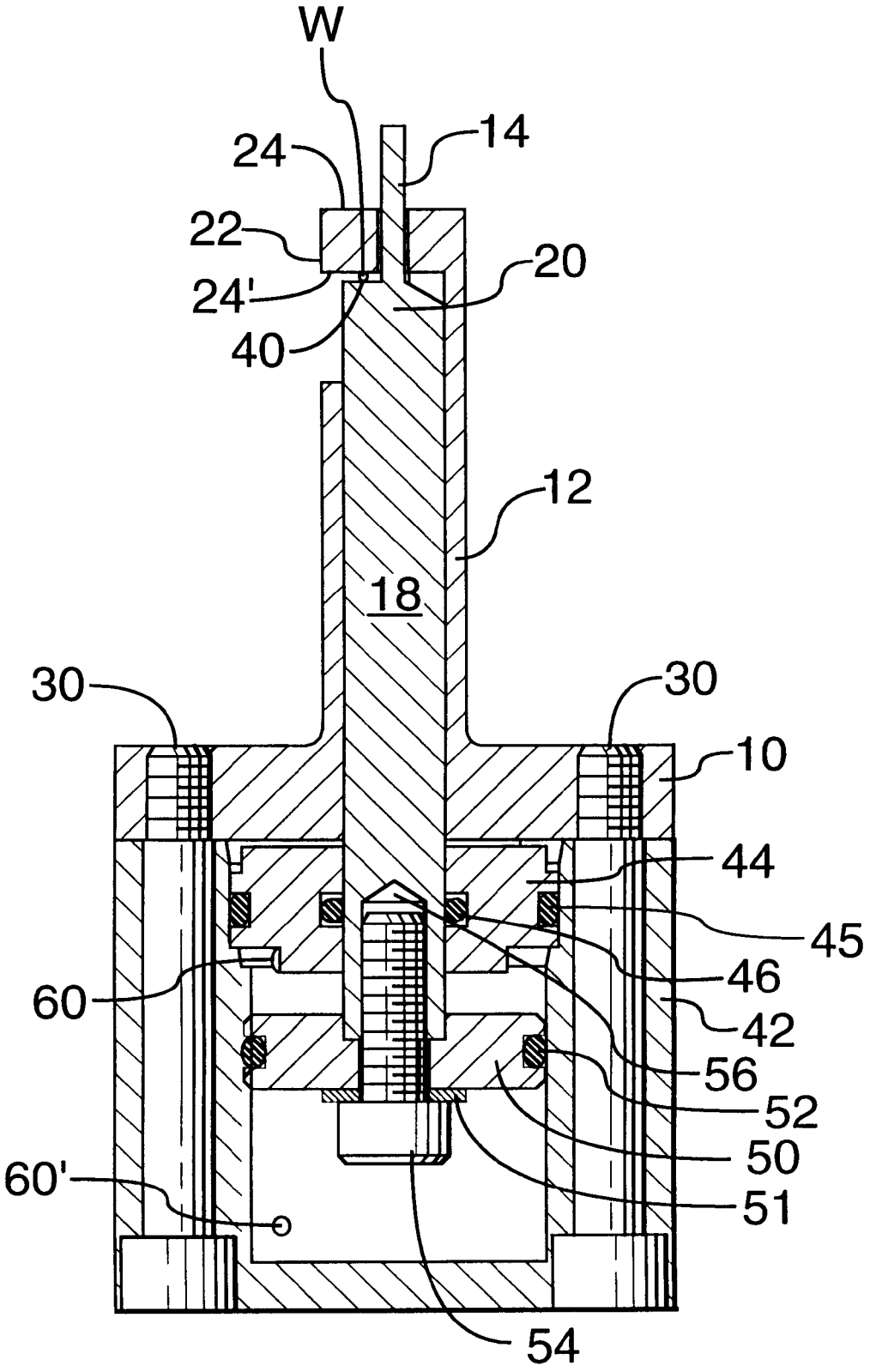
FIG. 7*a* is the view of FIG. 7 illustrating the plunger in an extended position and the coil being clamped in the clamping mode.
Figure 7B:
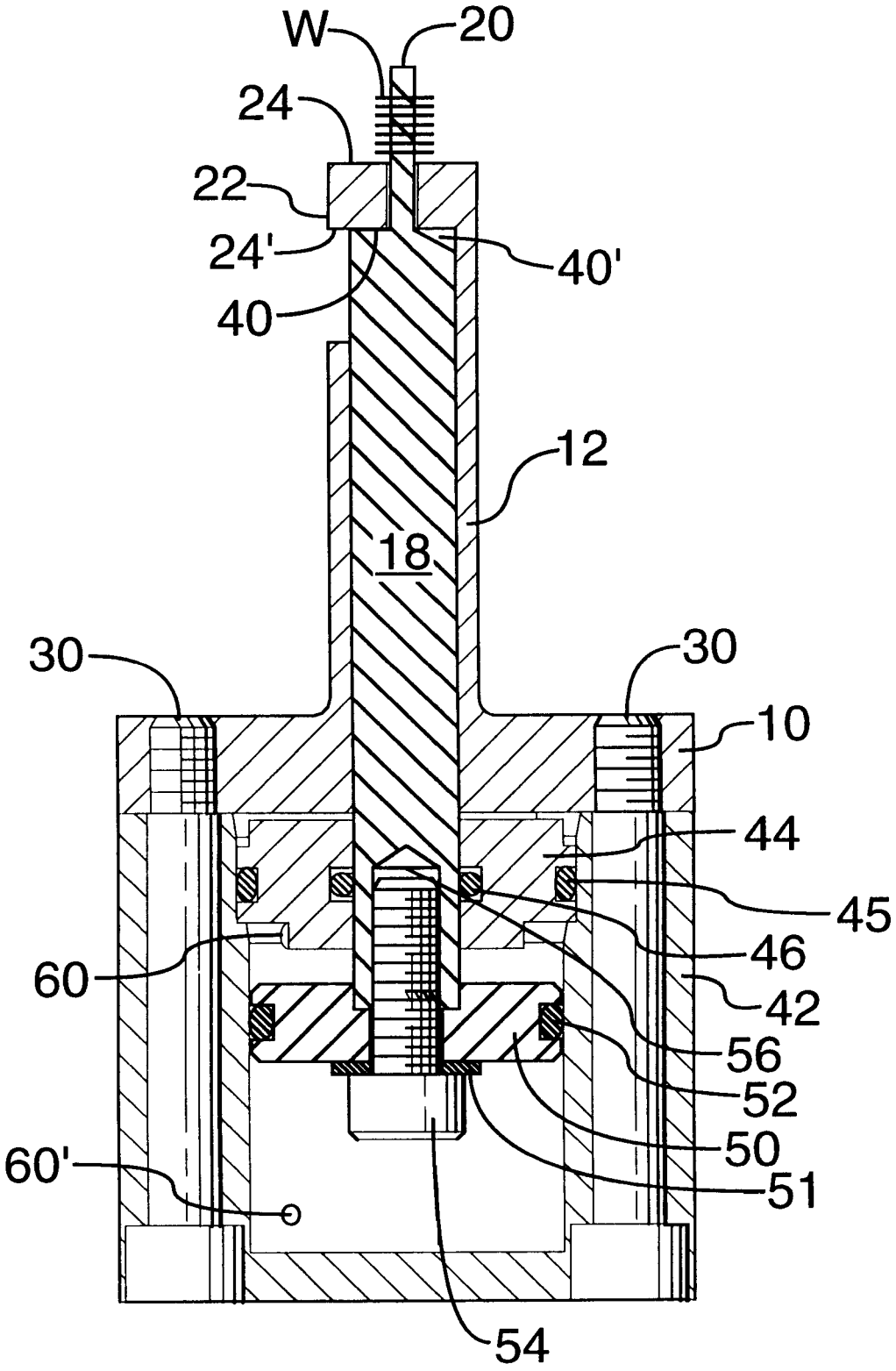
FIG. 7*b* is the view of FIG. 7 illustrating the plunger in an extended position and the coil being wrapped about the tie-off pin in the tie-off mode.
Figure 8:
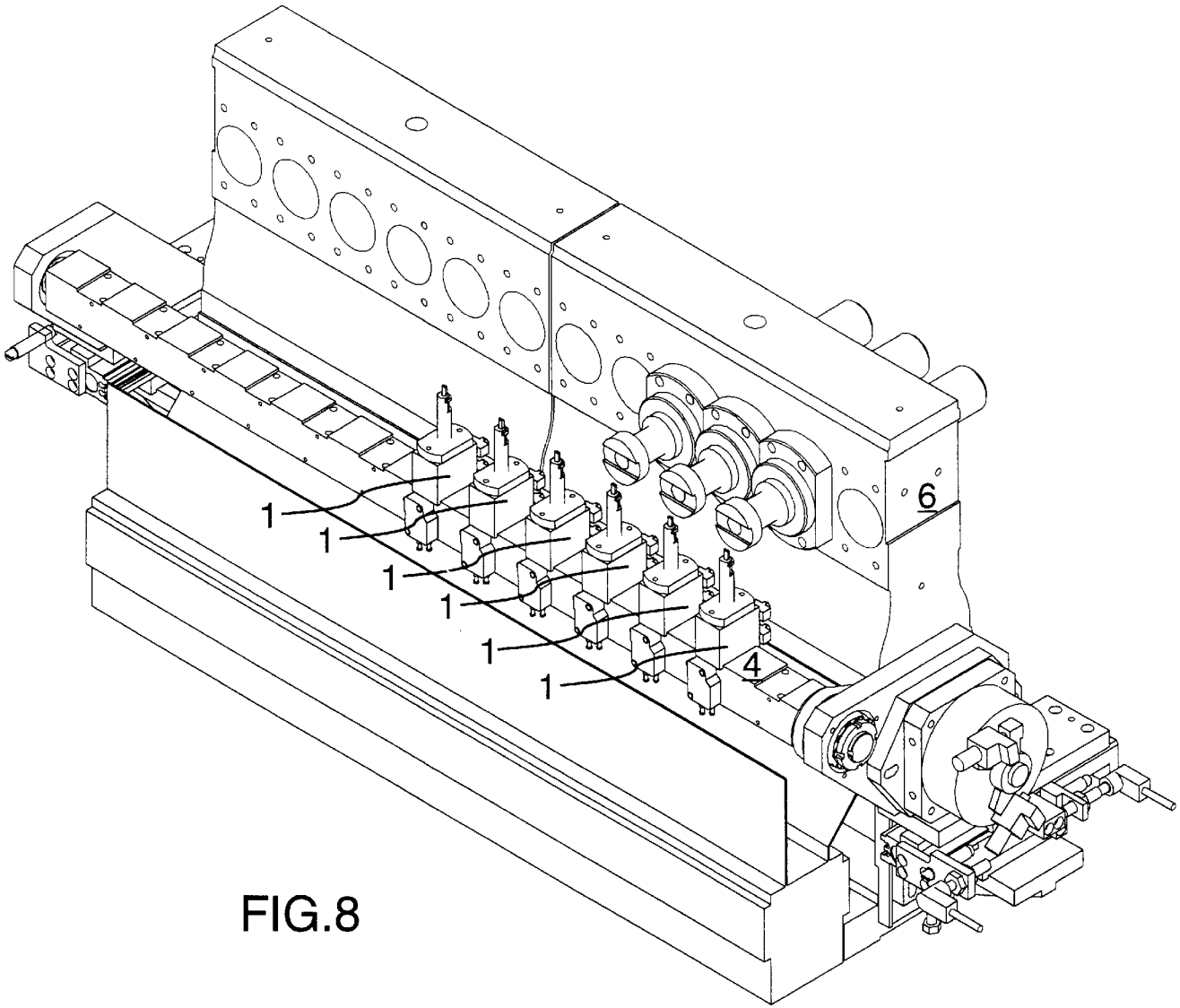
FIG. 8 is a perspective view of the overall set up of the hitching stations mounted onto a winding machine without the dispensing nozzle being illustrated.
Figure 9:
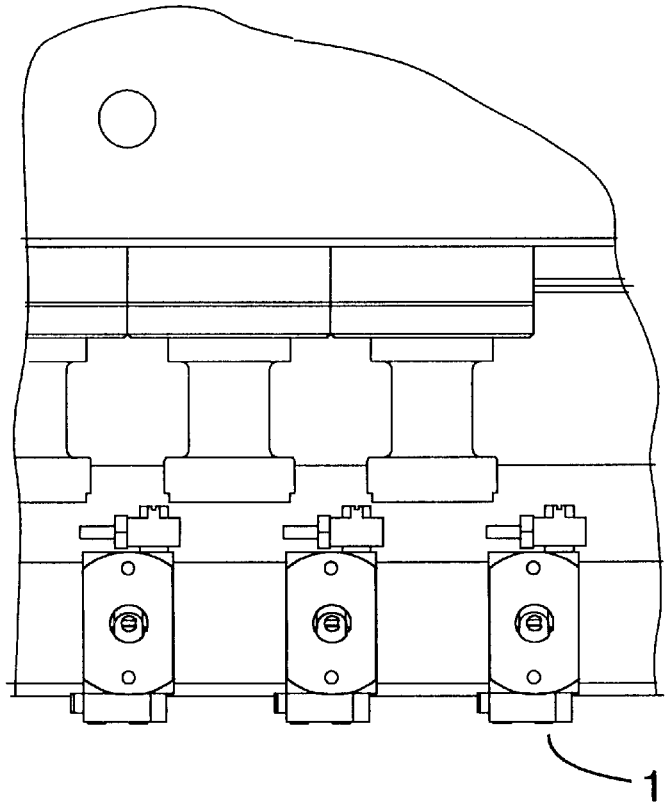
FIG. 9 is a partial plan view of FIG. 8.
Figure 10:
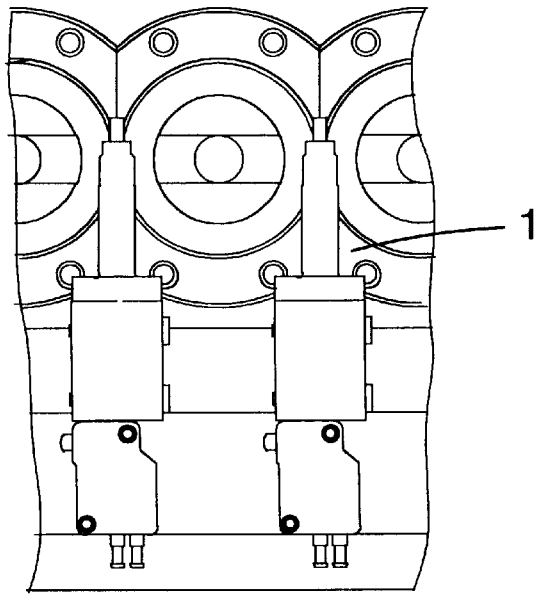
FIG. 10 is partial front view of FIG. 8.

The plunger has a rectangular tie-off pin 20 which extends upwardly from the top of the plunger. Although only a rectangular pin is shown, other shapes, such as a round or square shaped tie-off pin, may also be used. The first opening is configured to receive the tie-off pin therethrough with sufficient clearance so as to allow the tie-off pin, but not the plunger, to slide therethrough without resistance. The left shoulder surface 40, as shown in FIGS. 7–7*b*, of the plunger is preferably ground to be horizontally flush with a lower sleeve wall formed from the second opening 16, while the right shoulder 40' is simply chamferred for clearance purposes. As will be described later, the shoulder surface 40 constitutes a first or a lower clamping surface while the surface 24' constitutes a second or an upper clamping surface.

As shown in FIGS. 7–27*b*, within the lower body 42 there is preferably a pneumatically driven piston arrangement that actuates the plunger between an extended or a retracted position. The lower body is centrally bored via the top thereby forming an open-ended cylinder-shaped cavity to accommodate the piston arrangement. The pneumatic actuating valve mechanism that connects to the upper and lower air ports 60, 60' respectively is not shown. Other actuating means may be implemented; however, a pneumatic actuation was found to be far more easily manufactured and more cost effective than a mechanically driven actuating means found in the prior art. The synchronization and timing of the pneumatic valves is controlled by signals provided by the computer-controlled winding machine. FIG. 7 illustrates the final retracted position of the plunger when the pneumatic valve mechanism exhausts the air below the piston head via air port 60' and while driving air into the air pocket above the piston head via air port 60. In this position, the plunger is in a retracted position thereby retracting the tie-off pin within the sleeve via the first opening 14. In contrast, as shown in FIGS. 7*a*, 7*b*, when the pneumatic valve drives air into the air pocket below the piston head and exhausts the air pocket above the piston head, the plunger is in an extended position thereby exposing the tie-off pin. A stationary bushing 44, and static 45 and dynamic 46 O-rings provide for a sufficient air seal between the inner cylinder wall of the lower body and the plunger. Connected to the bottom of the plunger is a vertically movable piston head 50 that translates the pneumatic air pressure into vertical motion for the plunger. The piston head includes a dynamic O-ring 52 along the periphery to provide a sufficient air seal between the main air cavities above and below the piston head. A connector 54 in the form of a threaded screw secures the piston head to the plunger via a cooperating threaded bore 56. Any suitable connection means may be substituted for the connector so long as the piston head is connected securely to the plunger. Alternatively, the plunger—piston head arrangement may be integrally molded thereby alleviating the need for a connector. The upper vertical translation of the piston head comes to a rest when the surface 40 of the plunger confronts the opposing surface 24'.

The pneumatic valve mechanism is preferably configured so as to be mutually independent from the operation of the other valves connected to the other hitching stations. Each mechanism preferably also has a manual override option. Therefore, should a coil wire be accidently torn at any one station, an operator may restart the hitching process for the affected station using the override option without restarting the hitching or winding process for the other winding stations.

Operation

The decision to switch over to either a clamping mode operation or a tie-off mode operation is determined by the operator of the winding machine. It is generally preferable that the clamping mode is used because hitching is accomplished quicker than in the tie-off mode. However, in circumstances when coil has a small diameter the tie-off pin mode is required. Regardless of the mode chosen, the winding process is controlled by a programmed computer to accurately either implement the station in the clamping mode or the tie-off mode.

Clamping Mode

Figure 5:
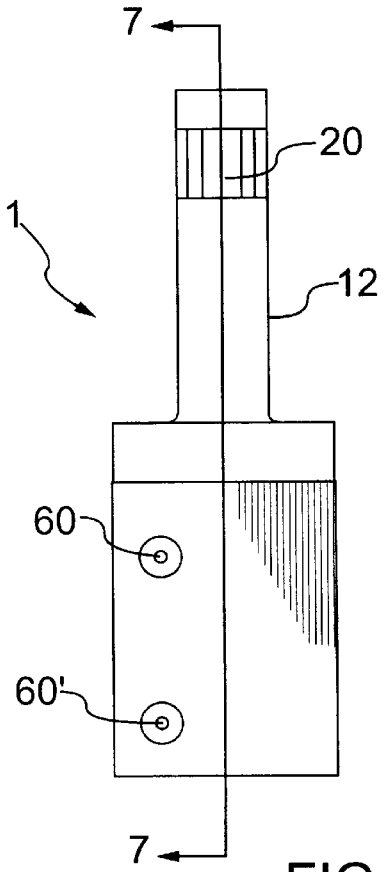
FIG. 5 is a rear view of FIG. 3.
Figure 5A:
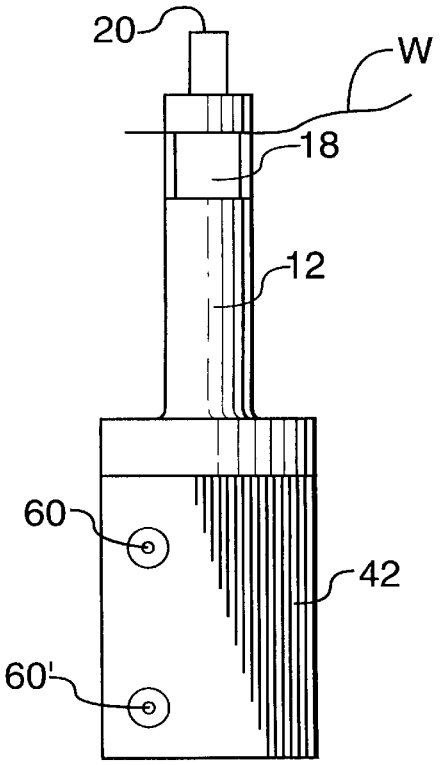
FIG. 5*a* is a view of FIG. 5 illustrating how the coil is clamped in the clamping mode.
Figure 6A:
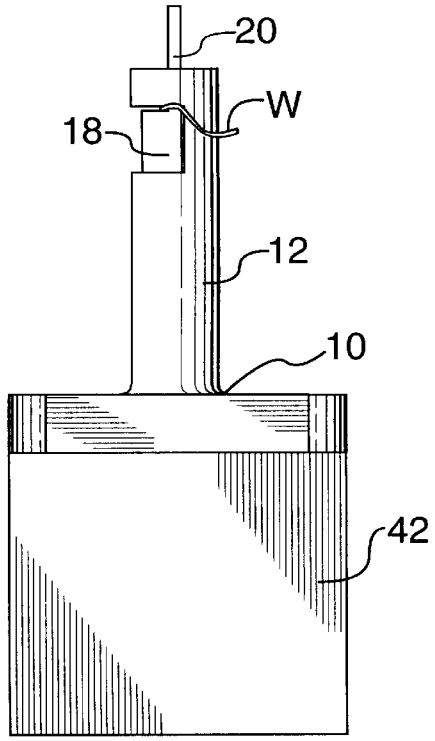
FIG. 6*a* is the view of FIG. 6 illustrating how the coil is clamped in the clamping mode.

In the clamping mode, the hitching station operates as follows. The plunger is actuated downwards by exhausting the air pocket below the piston head and pressurizing the air pocket above the piston head. As a result, the tie-off pin 20 is retracted into the sleeve via the first opening so as to provide a gap defined by the second opening 16 in the sleeve, the surface 24' of the top end, the vertical surface of the tie-off pin 20, and the shoulder surface 40 of the plunger. In the preferred embodiment, the nozzle positions the wire to rest within the gap. The gap is then reduced in size by actuating the plunger to the slide upwards thereby causing the shoulder surface 40 to confront the surface 24' with the wire clamped between the surfaces, as shown in FIGS. 5*a*, 6*a*. The clamped wire is then said to be 'hitched'. The wire dispensed from the nozzle may then be manipulated as desired by the winding machine.

Tie-off Mode

Figure 5B:
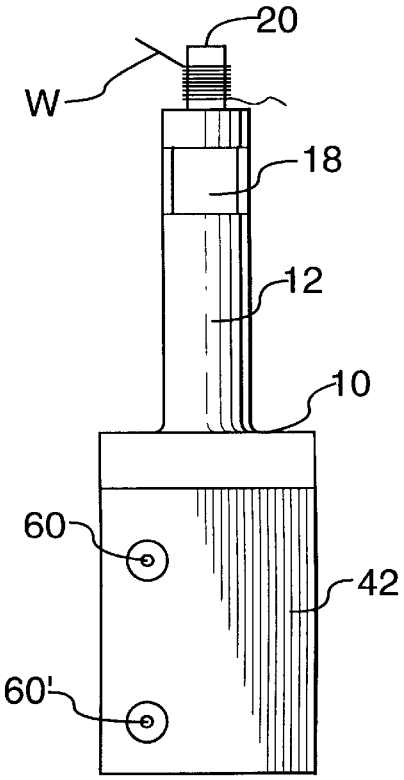
FIG. 5*b* is a view of FIG. 5 illustrating how the coil is wrapped about the tie-off pin in the tie-off mode.
Figure 6B:
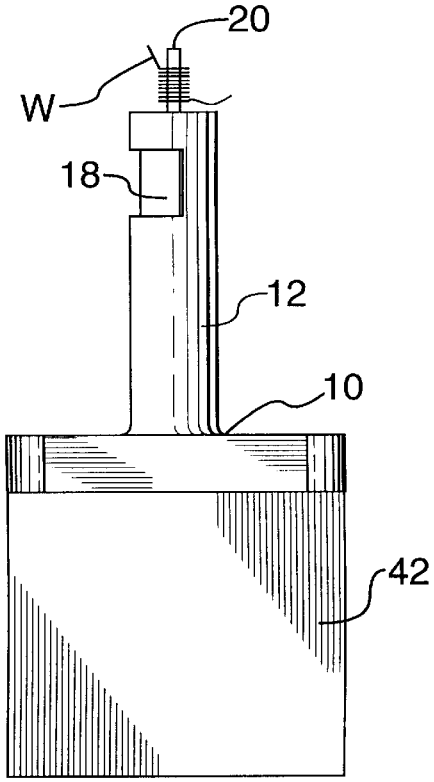
FIG. 6*b* is the view of FIG. 6 illustrating how the coil is wrapped about the tie-off pin in the tie-off mode.

In the tie-off mode, the hitching station operates as follows. As in the clamping mode, the plunger is actuated upwards; however, the plunger comes to rest when the clamping surfaces 24' and 40 are confronted. The wire dispensing nozzle then proceeds to wrap coil onto the exposed tie-off pin a number of times as shown in FIGS. 5*b*, 6*b*. When the coil is wrapped around the tie-off pin a number of times so as to secure the coil thereon, the coil is said to be 'hitched'. The coil dispensed from the nozzle may then be manipulated.

Dumping the Scrap

Figure 11:
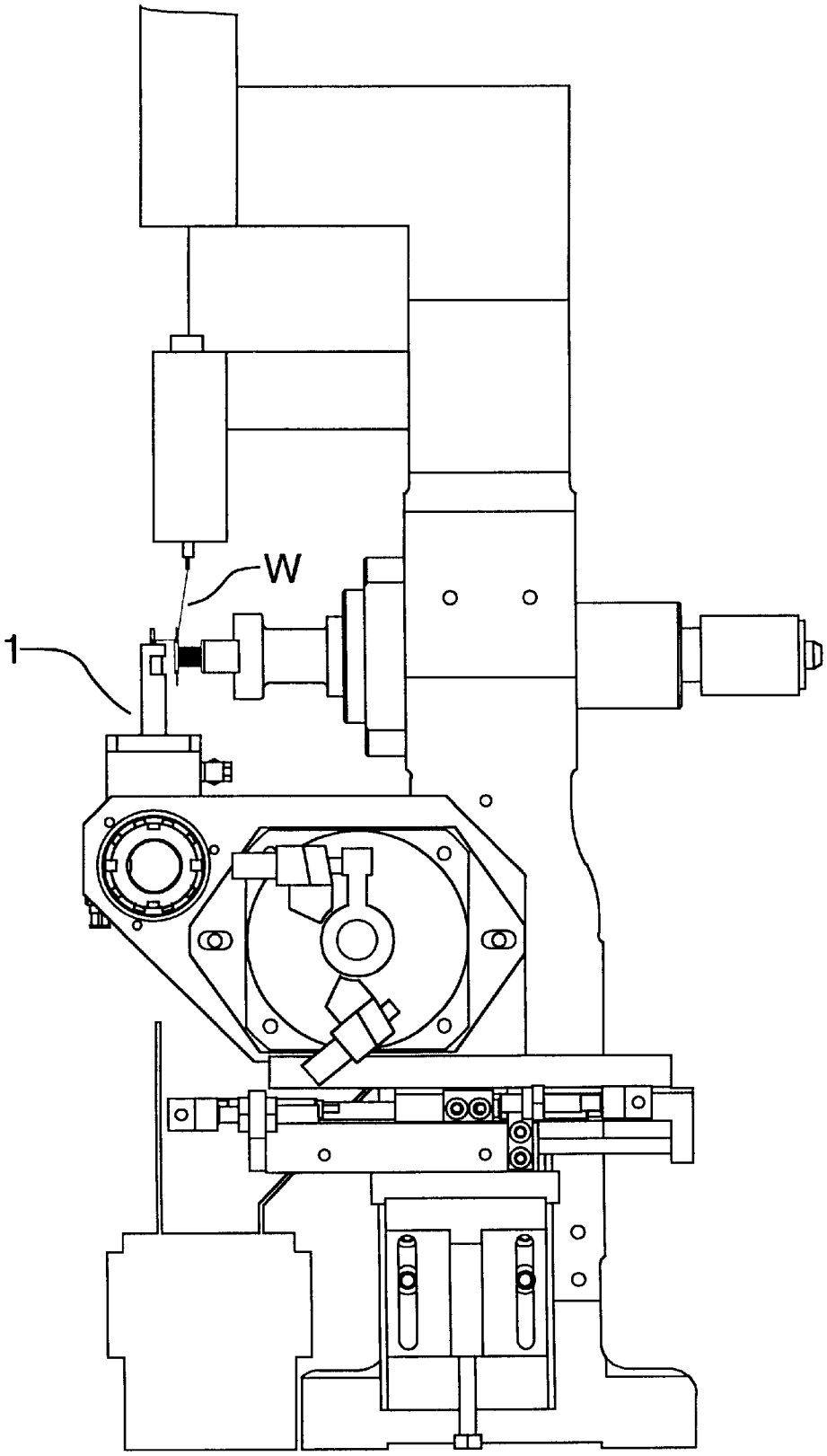
FIG. 11 is an end view of the winding apparatus with the coil dispensing nozzle in place.
Figure 11A:
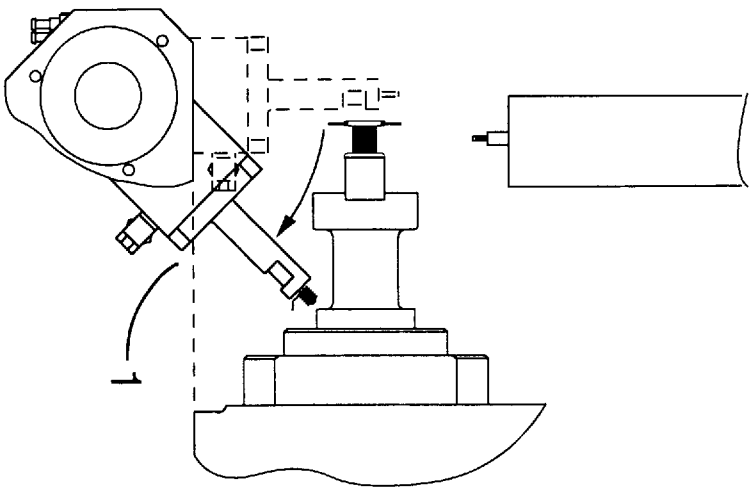
FIG. 11*a* is an end view of the winding apparatus with the hitching station rotating to discard a scrap coil after being wound about the tie-off pin.
Figure 11B:
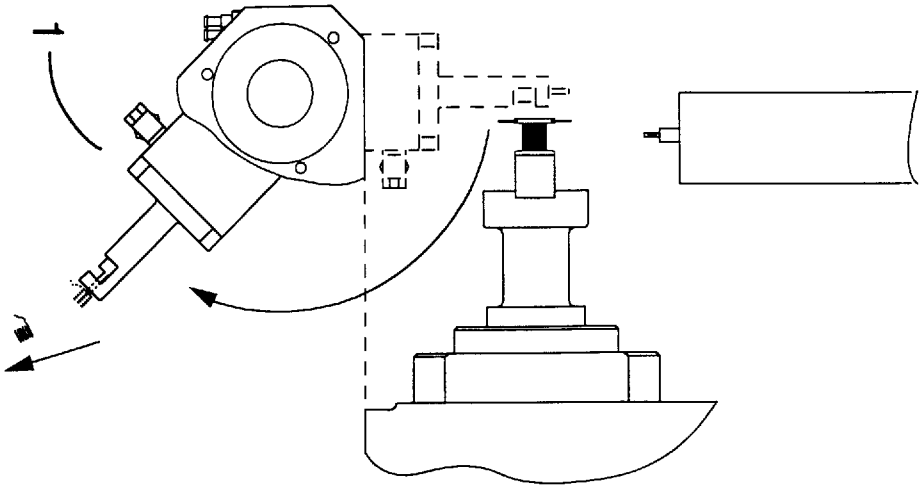
FIG. 11*b* is an end view of the winding apparatus with the hitching station discarding the scrap coil attached to the tie-off pin by retracting the tie-off pin into the sleeve.
Figure 11C:
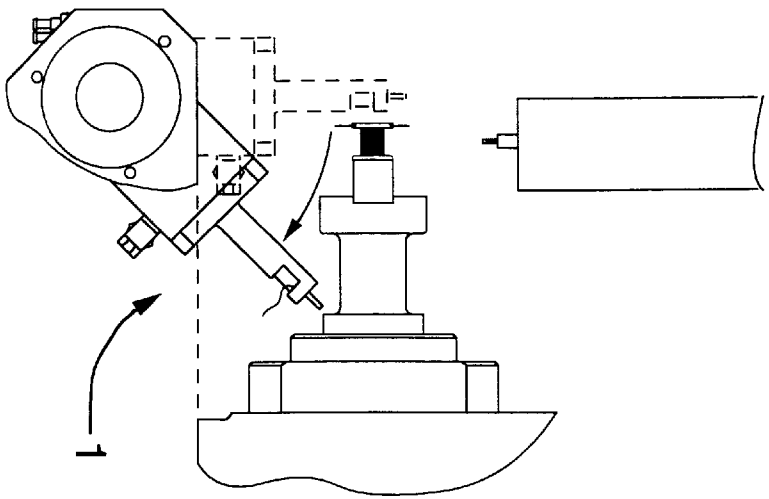
FIG. 11*c* is similar to the view of FIG. 11*a*, but instead illustrating the hitching station in a clamping mode operation.
Figure 11D:
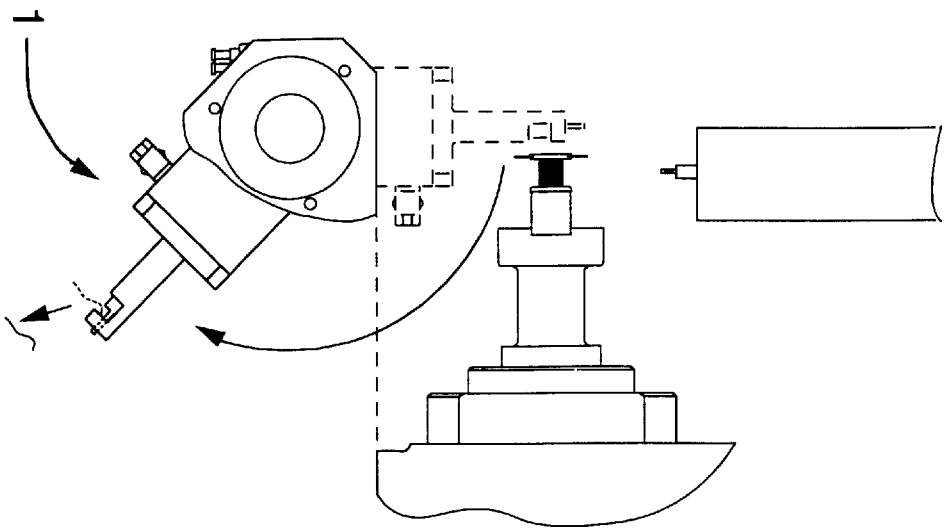
FIG. 11*d* is similar to the view of FIG. 11*b*, but instead illustrating the hitching station releasing the clamped surfaces to discard the scrap coil.
Figure 12A:
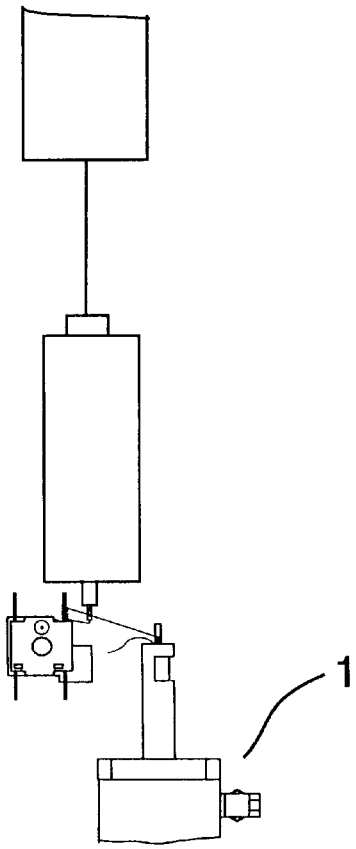
FIGS. 12*a*, 12*b* are schematics illustrating some steps of the winding process when the hitching station is used in the tie-off mode.
Figure 12B:
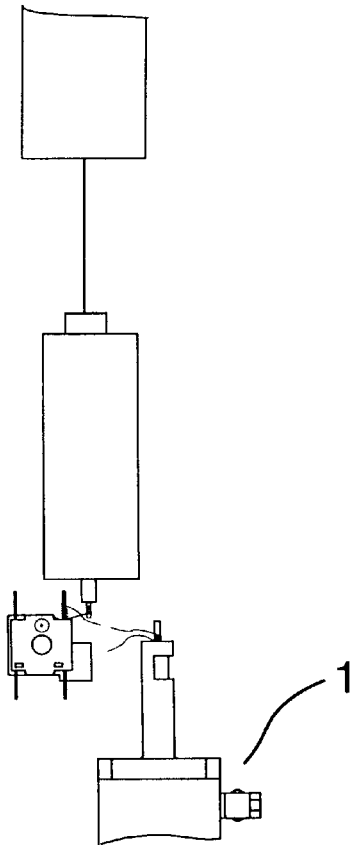
Figure 13B:
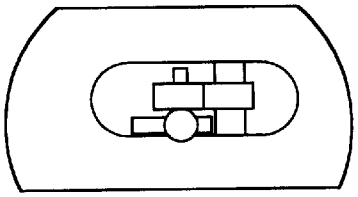
FIG.13b PRIOR ART
FIGS. 13, 13*a*, 13*b* are illustrations of the tie-off hitching station prior art; and, FIGS. 14, 14*a*, 14*b* are illustrations of the clamping hitching station prior art.
Figure 13:
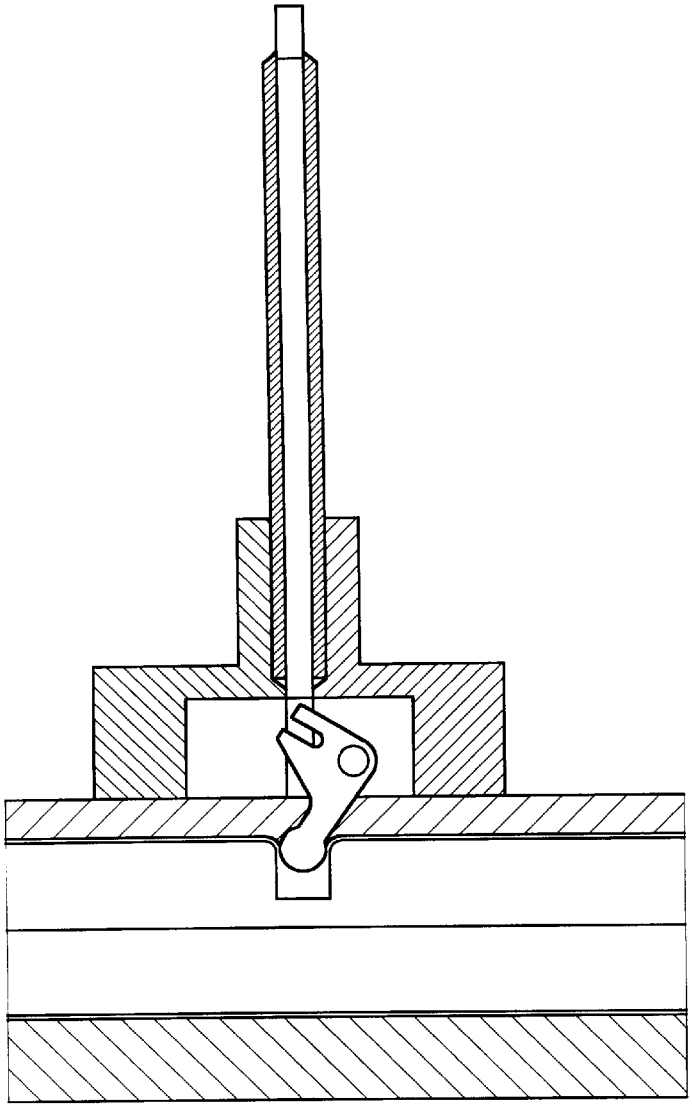
FIG.13 PRIOR ART
Figure 13A:
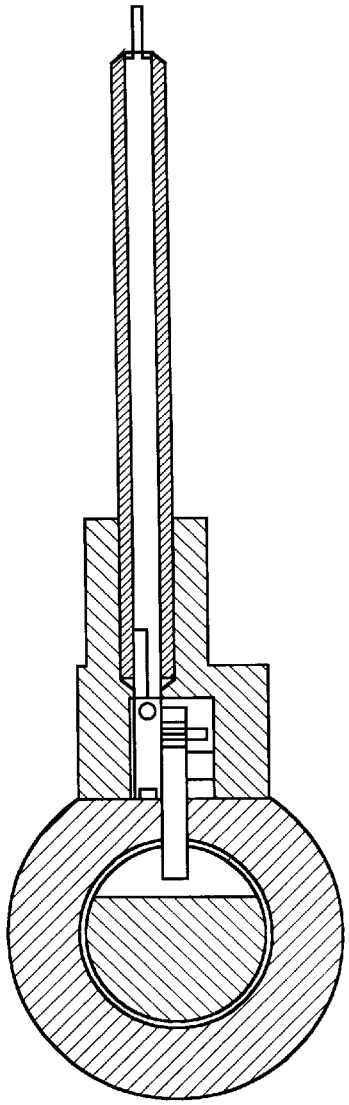
FIG.13a PRIOR ART
Figure 14B:
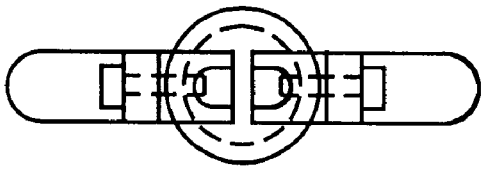
FIG.14b PRIOR ART
Figure 14A:
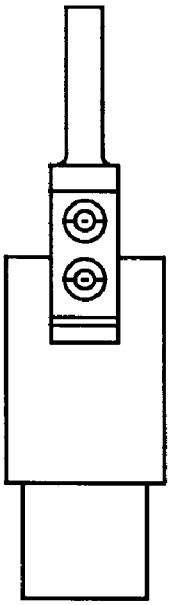
FIG.14a PRIOR ART
Figure 14:
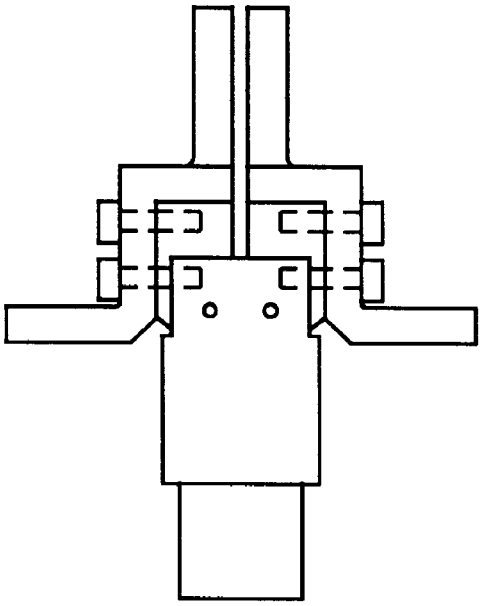
FIG.14 PRIOR ART

After the wire has been hitched and has been manipulated, as shown in FIG. 12*a*, the hitched wire portion is then cut from the rest of the coil. The cut portion of wire remaining on the station is referred to as scrap wire, as shown in FIG. 12*b*. When the hitching station discards this scrap wire that has either been clamped therein, or tied thereon, the station operates essentially the same in both modes. In both modes, the rail 4 that the hitching station is mounted on rotates preferably about 135° downwards from the vertical as shown in FIGS. 11*a*–11*d*. Next, the plunger and as a result the tie-off pin is retracted into the sleeve. In the case of the clamping mode, as best shown in FIGS. 11*c*–11*d*, the downward rotation of the station and the release of the clamping pressure is sufficient for the coil scrap to simply fall away from the clamping surfaces. In the tie-off mode, as best shown in FIGS. 11*a*–11*b*, retraction of the tie-off pin and the scrapping action of a portion of the top surface 24 adjacent to the tie-off pin strips the wire off the pin and allows the wire to fall away from the station. Accordingly, the clearance between the tie-off pin and the first opening should be sufficiently small so as to allow the adjacent top surface to work effectively as a wire scrapping surface. Although there is shown a flat top surface 24, it will be appreciated that a raised scrapping surface adjacent to the pin may also be effective to scrap the wire off the pin. In both modes, the scrap wire falls into a scrap conveyor (not shown) positioned below the station.

It will be appreciated that the above description relates to the preferred embodiment by way of example only. Many variations on the invention will be obvious to those knowledgeable in the field, and such obvious variations are within the scope of the invention as described and claimed, whether or not expressly described.

The embodiments of the invention in which an exclusive property or privilege is claimed are defined as follows:

1. A coil hitching device comprising:

a sleeve having a first and second opening, said first opening having a coil scrapping surface adjacent thereto, and said second opening having an upper clamping surface;

a plunger having a lower clamping surface opposing said upper clamping surface and a tie-off member disposed thereon, said plunger being slidably mounted within said sleeve and being positionable between:

a retracted position whereat said second opening of said sleeve and said lower clamping surface of said plunger define an exposed gap, and whereat said tie-off member is completely positioned within said sleeve; and, an extended position whereat said tie-off member is at least partially extending outside said sleeve via said first opening, and whereat said lower clamping surface confronts said upper clamping surface; and, actuation means for translating said plunger between said retracted and extended positions.

2. A device of claim 1, wherein said first opening is defined on a top end of said sleeve, said first opening extends between a top surface and said upper clamping surface, and wherein said second opening is defined on a lateral surface of said sleeve.

3. A device of claim 2, wherein said first opening and said tie-off member is rectangularly shaped.

4. A device of claim 3, wherein said coil scrapping surface is a portion of said top surface that delineates said first opening.

5. A device of claim 4, wherein said actuation means comprising a pneumatic piston arrangement disposed within a cavity of a base, said sleeve being disposed on said base.

6. A device of claim 5, where said piston arrangement comprising:

a piston head mounted onto an end of said plunger, said piston head being slidably mounted within said base;

a first and second air port on a wall of said base to communicate pneumatic pressures to said piston head, said first air port positioned above said piston head, and said second air port positioned below said piston head.

7. A device of claim 6, wherein said lower clamping surface forms at least a portion of a top end of said plunger.

8. A device of claim 7, wherein said tie-off member extends upwardly from said top end of said plunger.

9. A device of claim 8, wherein said upper and lower clamping surfaces are horizontal planes.

10. A coil hitching device comprising:

a sleeve member mounted on a base, said sleeve having a first and second opening, said first opening having a coil scrapping surface adjacent thereto, and said second opening having a first clamping surface;

a plunger having a tie-off member and a second clamping surface formed at a top end thereof, said second clamping surface being positioned to oppose said upper clamping surface, said plunger being slidably mounted within said sleeve and being positionable between:

a retracted position whereat said second opening of said sleeve and said lower clamping surface of said plunger define an exposed gap, and whereat said tie-off member is completely positioned within said sleeve; and, an extended position whereat said tie-off member is at least partially extending outside said sleeve via said first opening, and whereat said lower clamping surface confronts said upper clamping surface; and, actuation means disposed within said base for translating said plunger between said retracted and extended positions.

11. A device of claim 10, wherein said actuation means comprising a pneumatic piston arrangement disposed within a cavity of a base, said sleeve being disposed on said base.

* * * * *